US008985026B2

(12) United States Patent
Volkmann

(10) Patent No.: US 8,985,026 B2
(45) Date of Patent: Mar. 24, 2015

(54) PENETRATOR ROUND ASSEMBLY

(71) Applicant: Alliant Techsystems Inc., Minneapolis, MN (US)

(72) Inventor: Eric E. Volkmann, Plymouth, MN (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

(21) Appl. No.: 13/681,957

(22) Filed: Nov. 20, 2012

(65) Prior Publication Data

US 2013/0125774 A1 May 23, 2013

Related U.S. Application Data

(60) Provisional application No. 61/562,771, filed on Nov. 22, 2011.

(51) Int. Cl.
*F42B 12/06* (2006.01)
*F42B 14/06* (2006.01)

(52) U.S. Cl.
CPC ..... *F42B 12/06* (2013.01)
USPC ..... 102/521; 102/519

(58) Field of Classification Search
CPC ..... F42B 12/04; F42B 12/06; F42B 12/08; F42B 12/16; F42B 12/74; F42B 14/06; F42B 14/061; F42B 14/062
USPC ..... 102/518, 519, 520, 521, 522, 523, 517; 89/36.17
See application file for complete search history.

(56) References Cited

U.S. PATENT DOCUMENTS

| | | | | |
|---|---|---|---|---|
| 3,545,383 | A | 12/1970 | Lucy | |
| 3,888,636 | A | 6/1975 | Sczerzenie et al. | |
| 4,108,072 | A * | 8/1978 | Trinks et al. | 102/518 |
| 4,559,876 | A * | 12/1985 | Bocker et al. | 102/520 |
| 4,823,703 | A | 4/1989 | Donaldson | |
| 4,836,108 | A | 6/1989 | Kegel et al. | |
| 4,841,868 | A | 6/1989 | Jackson | |
| 4,872,409 | A * | 10/1989 | Becker et al. | 102/517 |
| 4,939,997 | A | 7/1990 | Hoffman | |
| 5,223,667 | A | 6/1993 | Anderson | |
| 5,442,989 | A | 8/1995 | Anderson | |
| 5,445,079 | A | 8/1995 | Boual | |
| 5,936,191 | A * | 8/1999 | Bisping et al. | 102/517 |

(Continued)

FOREIGN PATENT DOCUMENTS

| | | |
|---|---|---|
| DE | 3802002 | 8/1989 |
| EP | 0943887 | 9/1999 |

(Continued)

OTHER PUBLICATIONS

Jane's Ammunition Handbook, "105 mm L52 APDS-T cartridge (United Kingdom), Tank and anti-tank guns", International Defence Industry Exhibition, Jul. 6, 2010, http://articles.janes.com/articles/Janes-Ammunition-Handbook/105-mm-L52-APDS-T-cartridge-United-Kingdom.html.

(Continued)

*Primary Examiner* — James S Bergin
(74) *Attorney, Agent, or Firm* — Vidas, Arrett & Steinkraus

(57) ABSTRACT

Techniques are described for penetrating protective vehicle armor. In one example, a penetrator round assembly comprises a main penetrator rod comprising a tungsten alloy and a solid nose engaged to the main penetrator rod.

14 Claims, 4 Drawing Sheets

(56) References Cited

U.S. PATENT DOCUMENTS

| | | | | |
|---|---|---|---|---|
| 6,035,501 | A | 3/2000 | Bisping et al. | |
| 6,085,661 | A | 7/2000 | Halverson et al. | |
| 6,186,072 | B1 | 2/2001 | Hickerson, Jr. et al. | |
| 6,662,726 | B1 | 12/2003 | Steiner | |
| 7,231,876 | B2 * | 6/2007 | Kellner | 102/517 |
| 8,522,687 | B2 * | 9/2013 | Liu | 102/519 |
| 2004/0158969 | A1 | 8/2004 | Ortmann et al. | |
| 2005/0109233 | A1 | 5/2005 | Eches et al. | |
| 2013/0125774 | A1 * | 5/2013 | Volkmann | 102/519 |

FOREIGN PATENT DOCUMENTS

| | | | |
|---|---|---|---|
| EP | 987513 | | 3/2000 |
| EP | 2597416 | A2 * | 5/2013 |
| FR | 2629581 | | 10/1989 |
| FR | 2648222 | | 12/1990 |
| GB | 579205 | | 7/1946 |
| GB | 1095992 | | 12/1967 |
| GB | 1514908 | | 6/1978 |
| GB | 2257238 | | 1/1993 |

OTHER PUBLICATIONS

Terminal Balistics, "Small caliber terminal ballistics", Citizendia, http://www.citizendia.org/Terminal_ballistics; Aug. 2011.

Keij T., "Description and validation of an improved frangible armour piercing munition model", TNO Defence Research, Jun. 1993.

Stubberfield, J., Lynch, N., and Wallis, I. "Comparisons of Unitary and Jacketed Rod Penetration Into Semi-Infinite and Oblique Plate Targets at System Equivalent Velocities" http://ciar.org/ttk/mbt/papers/lakowski.2006-09/ISB_22_Comparison_of Unitary_and_Jacketed_Rod_Penetrators.pdf.

Caldwell, J. and Bolton, C., "United States Army Weapons Systems 2002", http://205.153.241.62/FA45_D085/GFI/CGSC/c400S/lib_docs/docs/WSH.pdf.

DiGiulian, Tony, "Definitions and Information about Naval Guns, Part 2—Ammunition, Fuzes, Projectiles and Propellants", Jun. 20, 2011, http://www.navweaps.com/Weapons/Gun_Data_p2.htm.

* cited by examiner

PENETRATOR ROUND ASSEMBLY

TECHNICAL FIELD

The disclosure generally relates to munitions and, more particularly, to projectiles that can penetrate reactive armor.

BACKGROUND

Explosive reactive armor is a type of vehicle armor that is designed to reduce the amount of penetration of projectiles, e.g., anti-tank rounds. In general, explosive reactive armor includes an explosive material sandwiched between two plates, e.g., metal plates. The plates and explosive material form a block-like module. Numerous modules are distributed over the base armor of a vehicle, e.g., tank, in order to form a protective layer of explosive reactive armor.

Generally speaking, in operation the explosive reactive armor is designed to deflect a projectile by altering the angle of incidence of the projectile to prevent the projectile from perforating the base armor of the vehicle. More particularly, as the projectile impacts the outermost plate of an explosive reactive armor module, the explosive material ignites. The ignition of the explosive material causes the two plates of the module to be driven apart. As the outer (or cover) plate is driven outward into the projectile, the outer plate damages, e.g., breaks or bends, the penetrator rod of the projectile. As the inner plate is driven inward away from the projectile, a longer path-length is created for the projectile, thereby reducing the chance that the projectile will perforate the vehicle's base armor.

SUMMARY

This disclosure generally describes a penetrator round assembly having a main penetrator rod and nose designed to penetrate explosive reactive armor. Using various techniques described in this disclosure, the penetrator round assembly perforates explosive reactive armor ("ERA") cover plates and absorbs the initial energy from the moving ERA plates without significantly bending the main penetrator rod.

In one example, this disclosure is directed to a penetrator round assembly comprising a main penetrator rod comprising a tungsten alloy, and a solid nose engaged to the main penetrator rod.

In another example, this disclosure is directed to a penetrator round assembly comprising a main penetrator rod comprising a tungsten alloy, and a solid steel nose engaged to the main penetrator rod, wherein a ratio of a length of the main penetrator rod and a diameter of the main penetrator rod is greater than about 25.

In another example, this disclosure is directed to a penetrator round assembly comprising a main penetrator rod comprising a tungsten alloy, and a solid steel nose engaged to the main penetrator rod, wherein a ratio of a length of the main penetrator rod and a diameter of the main penetrator rod is greater than about 25, wherein neither the main penetrator rod nor the nose comprise depleted uranium, and wherein the main penetrator rod does not comprise cobalt.

The details of one or more aspects of the disclosure are set forth in the accompanying drawings and the description below. Other features, objects, and advantages will be apparent from the description and drawings, and from the claims.

DETAILED DESCRIPTION

In general, this disclosure describes a penetrator round assembly having a main penetrator rod and nose designed to penetrate explosive reactive armor. The penetrator round assembly includes a solid steel nose that is sufficiently robust to perforate explosive reactive armor ("ERA") cover plates and absorb the initial energy from the moving ERA cover plates without significantly bending the main penetrator rod of the assembly. In addition, the main penetrator rod of the assembly has a greater bending stiffness than other penetrator round assemblies, thereby allowing the main penetrator rod of this disclosure to absorb the grinding interaction of moving ERA cover plates better than the other penetrator round assemblies. In addition, the penetrator round assembly described in this disclosure allows a user to engage enemy vehicles, e.g., tanks, at longer ranges as compared to other penetrator round assemblies. A longer engagement range increases the chance that the user will survive the encounter with enemy forces.

Figure 1:
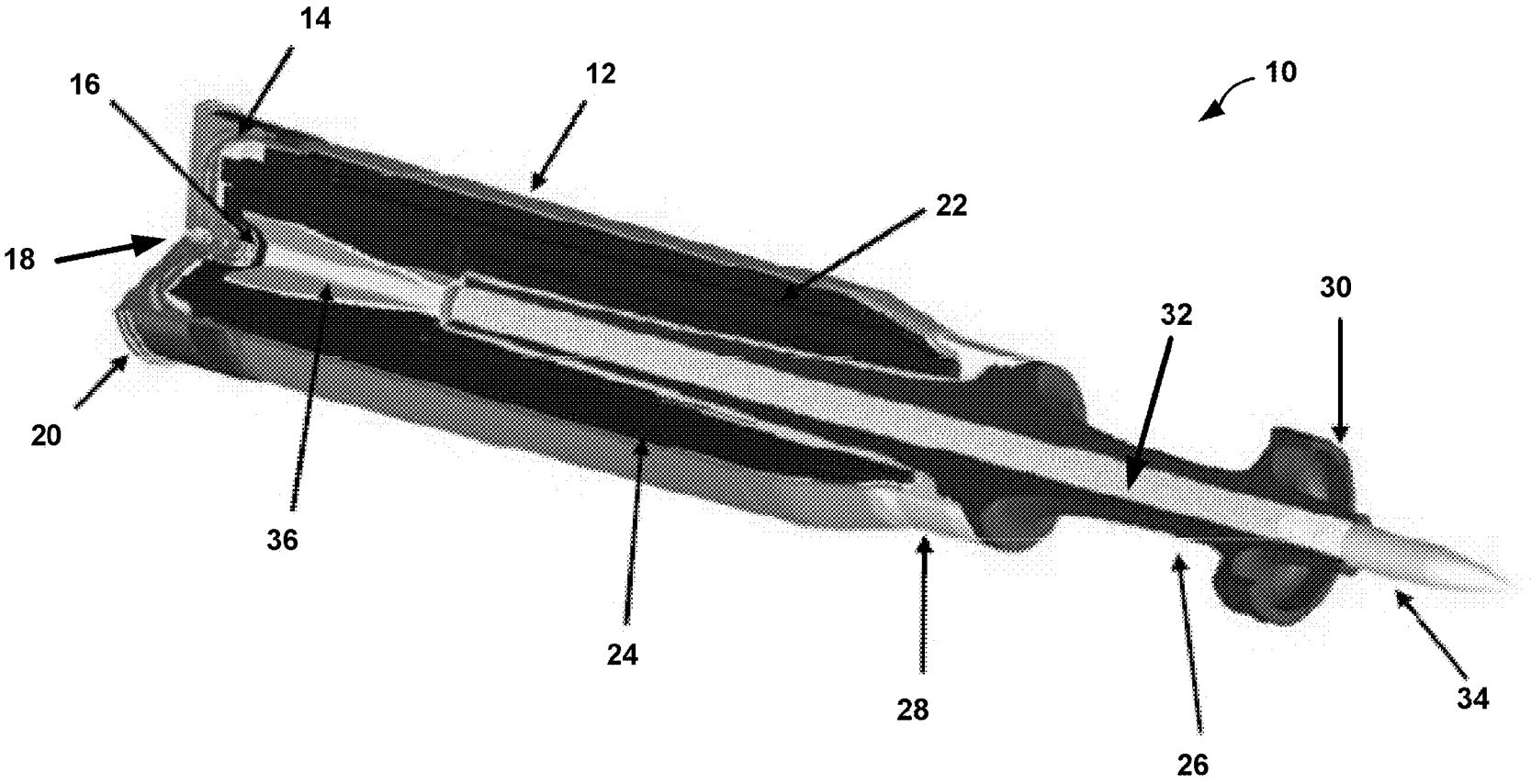
FIG. 1 is a perspective view of an example penetrator round assembly, in accordance with this disclosure.

FIG. 1 is a perspective view of an example penetrator round assembly, in accordance with this disclosure. The example penetrator round assembly of FIG. 1, shown generally at 10, includes combustible cartridge case system 12, spring disc 14, visibility tracer 16, electric primer 18, case base and seal assembly 20, stick propellant 22, propellant bag 24, sabot 26, nylon obturator 28, anti-split ring 30, main penetrator rod 32, nose 34, and fins 36. In some examples, penetrator round assembly 10 is fired from the main gun of a tank.

In accordance with this disclosure, main penetrator rod 32, in contrast to other penetrator round assemblies currently available, does not include depleted uranium. Rather, main penetrator rod 32 is comprised of an alloy containing a minimum of 90% tungsten by weight. The tungsten alloy of main penetrator rod 32 does not, however, include cobalt.

In addition and in accordance with this disclosure, nose 34 is comprised of solid steel, e.g., solid stainless steel. Nose 34 does not include depleted uranium. Because of its solid design, nose 34 will perforate ERA cover plates, ignite the explosive material, and absorb the initial energy from the moving ERA cover plates without significantly bending the main penetrator rod of the assembly. As the ERA cover plates move, the cover plates erode away nose 34 rather than damaging main penetrator rod 32. In this manner, nose 34 can be thought of as a sacrificial element. That is, nose 34 takes the brunt of the effects of the explosion from the ERA, thereby allowing main penetrator rod 32 to continue straight without substantially bending or deflecting. While this disclosure refers specifically to a solid steel nose, it should be noted that nose 34 may be made of a material other than steel, provided that the material has a density that is greater than or equal to steel.

In contrast to nose 34, other currently available penetrator round assemblies utilizes hollow steel noses. The hollow steel nose design acts as a windshield for the round and is used for aerodynamic purposes rather than for penetrating cover plates, as described in this disclosure.

Figure 2:
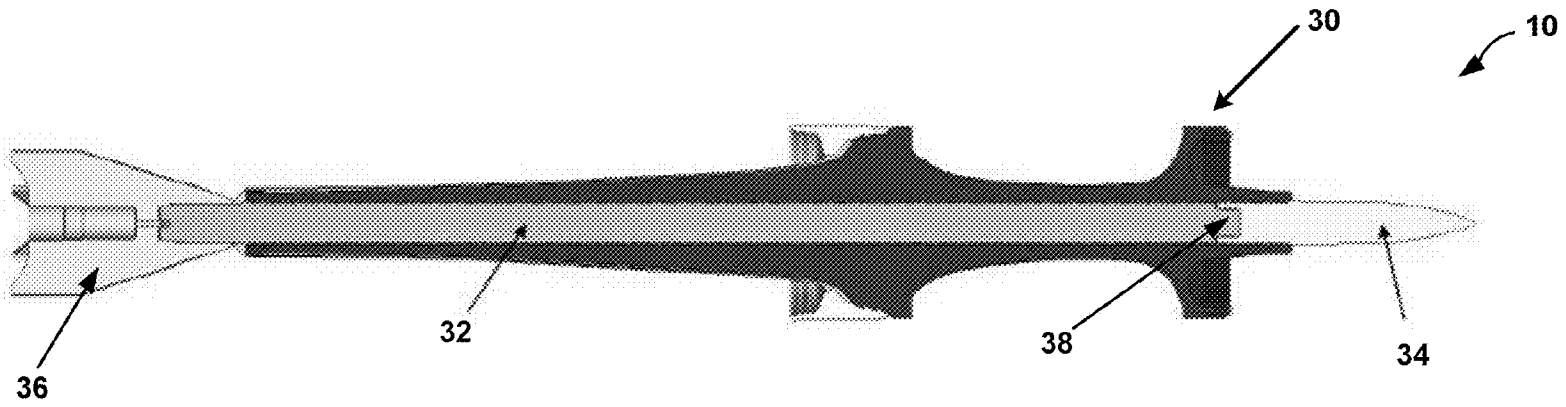
FIG. 2 is a longitudinal cross-sectional view of a portion of the example penetrator round of FIG. 1.

FIG. 2 is a longitudinal cross-sectional view of a portion of the example penetrator round of FIG. 1. Nose 34 is joined directly to main penetrator 32. In particular, main penetrator 32 includes threaded portion 38 upon which a portion nose 34 is attached.

Figure 3:
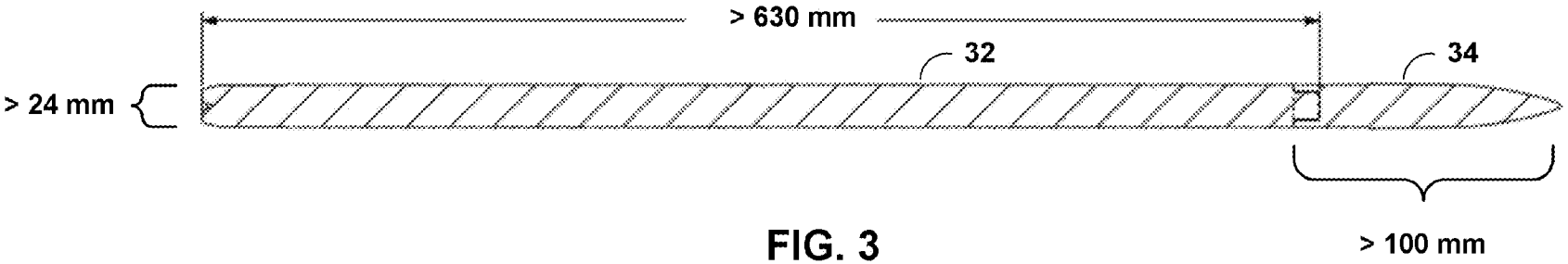
FIG. 3 is a schematic view of an example main penetrator rod and nose assembly, in accordance with this disclosure.

FIG. 3 is a schematic view of an example main penetrator rod and nose assembly, in accordance with this disclosure. In the example depicted in FIG. 3, main penetrator rod 32 has a length greater than 630 millimeters (mm) and the nose 34 has a length of greater than 100 mm. In other examples, main penetrator rod 32 has a length greater than about 630 mm, preferably greater than about 650 mm, and more preferably greater than about 670 mm.

In addition and in accordance with this disclosure, main penetrator rod 32 has a diameter of greater than 24 mm. In one example configuration, main penetrator rod 32 has a diameter of about 25 mm. By utilizing a diameter greater than 24 mm, main penetrator rod 32 can absorb the grinding interaction of moving ERA plates better than rods with small diameters due to its increased bending stiffness. The bending stiffness of the main penetrator rod is proportional to the diameter of the road raised to the $4^{th}$ power. For example a 25 mm diameter rod is approximately 67% stiffer than a 22 mm diameter rod ($25^4/22^4=1.67$). Importantly, the length-to-diameter ratio is greater than about 25 for the penetrator round assembly.

In addition and as indicated above, main penetrator rod 32 does not include depleted uranium. Rather, main penetrator rod 32 is comprised of a tungsten alloy. The alloy comprises at least 90% tungsten and further includes nickel and iron, but does not include cobalt.

Figure 4:
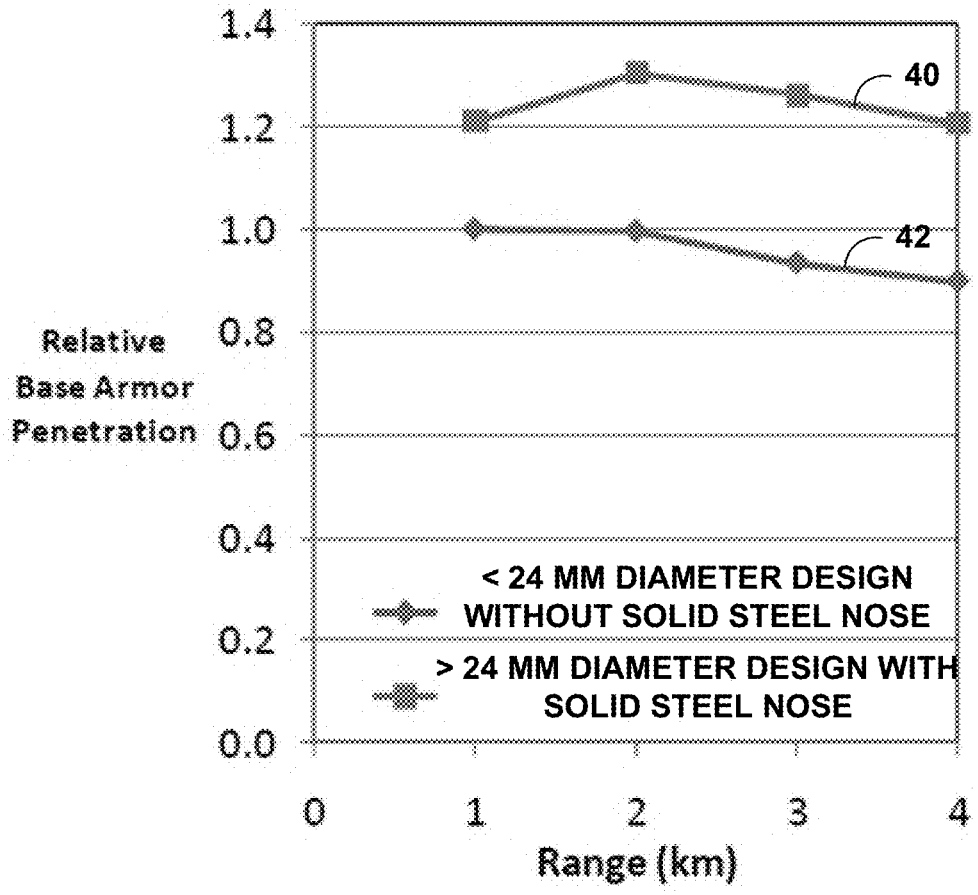
FIG. 4 is a graph depicting relative base armor penetration at various ranges for two penetrator round assemblies against ERA.

FIG. 4 is a graph depicting relative base armor penetration at various ranges for two penetrator round assemblies against ERA. In particular, FIG. 4 depicts predicted base armor penetration (y-axis) of a vehicle protected by ERA using a penetrator round assembly that has a diameter that is greater than about 24 mm and uses a solid steel nose, in accordance with this disclosure, relative to a penetrator round assembly that has a diameter less than 24 mm diameter and uses a hollow nose design over a range of 4 kilometers (km) (x-axis). In FIG. 4, the armor penetration is normalized by the penetration depth of the penetrator round assembly that uses a hollow nose design at 1 km. As seen in FIG. 4, the design with the solid steel nose, indicated by line 40, outperforms the design with a hollow nose design, indicated by line 42, by at least 20% over a range of about 1-4 km. That is, the design with the solid steel nose, as described in this disclosure, perforates the base armor to a depth that is at least 20% more than the hollow nose design over a range of about 1-4 kilometers (km).

Figure 5:
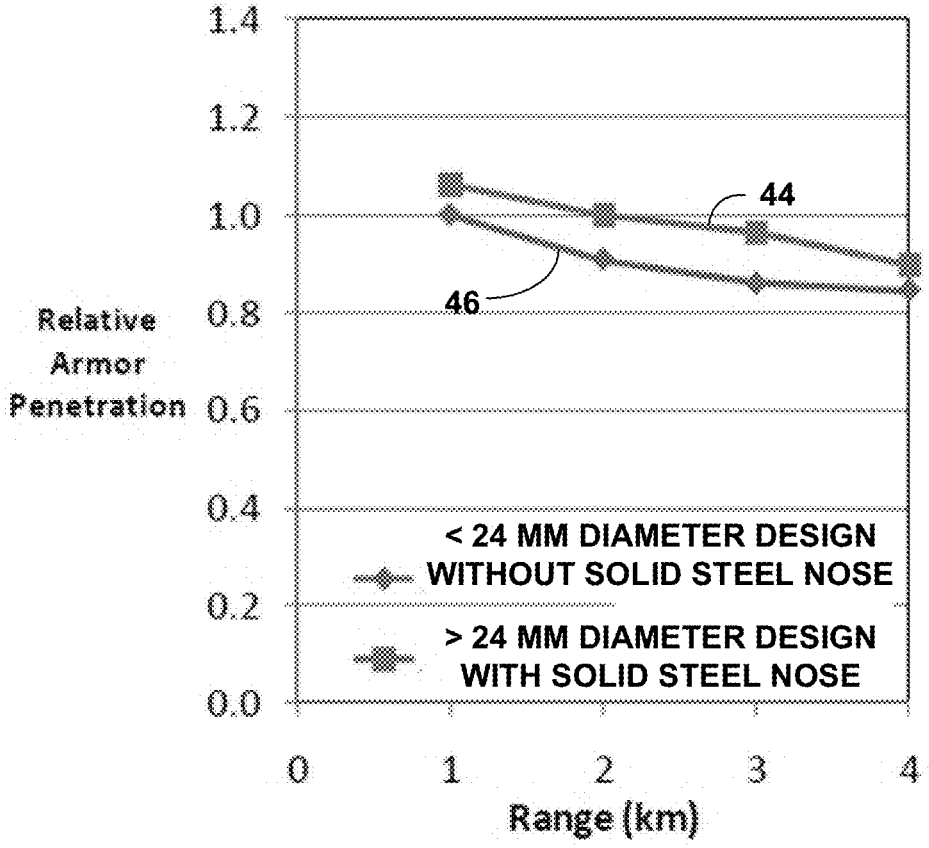
FIG. 5 is a graph depicting relative base armor penetration at various ranges for two penetrator round assemblies against semi-infinite rolled homogeneous armor (RHA).

FIG. 5 is a graph depicting relative base armor penetration at various ranges for two penetrator round assemblies against semi-infinite rolled homogeneous armor (RHA). In particular, FIG. 5 depicts the predicted base armor penetration (y-axis) of a vehicle protected by RHA using a penetrator round assembly that has a diameter greater than about 24 mm and uses a solid steel nose, in accordance with this disclosure, relative to a penetrator round assembly that has a diameter less than 24 mm and uses a hollow nose design over a range of 4 km (x-axis). In FIG. 5, the armor penetration is normalized by the penetration depth of the penetrator round assembly that uses a hollow nose design at 1 kilometer (km). As seen in FIG. 5, the design with the solid steel nose, indicated by line 44, outperforms the design with a hollow nose design, indicated by line 46, over a range of about 1-4 kilometers (km). That is, the design with the solid steel nose, as described in this disclosure, perforates the base armor to a depth that is deeper than that of the hollow nose design over a range of about 1-4 kilometers (km).

Various aspects of the disclosure have been described. These and other aspects are within the scope of the following claims.

The invention claimed is:

1. A penetrator round assembly comprising:

a main penetrator rod comprising a tungsten alloy; and a sacrificial solid nose engaged to the main penetrator rod, wherein the nose has a density that is greater than or equal to steel, wherein the nose is configured to perforate an explosive reactive armor cover plate and absorb the initial energy from and be eroded by movement of the cover plate.

2. The penetrator round assembly of claim 1, wherein the nose is a solid steel nose.

3. The penetrator round assembly of claim 1, wherein the main penetrator rod has a monolithic construction.

4. The penetrator round assembly of claim 1, wherein the main penetrator rod has a diameter of greater than about 24 millimeters.

5. The penetrator round assembly of claim 1, wherein the main penetrator rod has a length greater than 630 millimeters.

6. The penetrator round assembly of claim 1, wherein the nose has a length that is greater than about 100 millimeters.

7. The penetrator round assembly of claim 1, wherein a ratio of a length of the main penetrator rod and a diameter of the main penetrator rod is greater than about 25.

8. The penetrator round assembly of claim 1, wherein the main penetrator rods does not comprise depleted uranium.

9. The penetrator round assembly of claim 1, wherein the nose does not comprise depleted uranium.

10. The penetrator round assembly of claim 1, wherein a ratio of a length of the main penetrator rod and a diameter of the main penetrator rod is greater than about 25.

11. The penetrator round assembly of claim 1 further, wherein a ratio of a length of the main penetrator rod and a diameter of the main penetrator rod is greater than about 25, wherein neither the main penetrator rod nor the nose comprise depleted uranium, and wherein the main penetrator rod does not comprise cobalt.

12. The penetrator round assembly of claim 1 further, wherein the main penetrator rod has a monolithic construction, wherein the main penetrator rod has a diameter of greater than about 24 millimeters, wherein the main penetrator rod has a length greater than 630 millimeters, wherein the nose has a length that is greater than about 100 millimeters, wherein a ratio of the length of the main penetrator rod and the diameter of the main penetrator rod is greater than about 25, wherein neither the main penetrator rod nor the nose comprise depleted uranium, and wherein the main penetrator rod does not comprise cobalt.

13. The penetrator round assembly of claim 1 further, wherein the main penetrator rod has a monolithic construction, wherein the main penetrator rod has a diameter of greater than about 24 millimeters, wherein the main penetrator rod has a length greater than 630 millimeters, wherein the nose has a length that is greater than about 100 millimeters, wherein a ratio of the length of the main penetrator rod and the diameter of the main penetrator rod is greater than about 25, wherein neither the main penetrator rod nor the nose comprise depleted uranium, wherein the main penetrator rod does not comprise cobalt, and wherein when the steel nose impacts the cover plate of the explosive reactive armor ("ERA") module, the steel nose absorbs an initial energy from a movement of the ERA cover plate without significantly bending the main penetrator rod.

14. The penetrator round assembly of claim 1 further, wherein the main penetrator rod has a monolithic construction, wherein the main penetrator rod has a diameter of greater than about 24 millimeters, wherein the main penetrator rod has a length greater than 630 millimeters, wherein the nose has a length that is greater than about 100 millimeters, wherein a ratio of the length of the main penetrator rod and the diameter of the main penetrator rod is greater than about 25, wherein neither the main penetrator rod nor the nose comprise depleted uranium, wherein the main penetrator rod does not comprise cobalt, and wherein when the nose impacts the cover plate of the explosive reactive armor ("ERA") module, the nose absorbs an initial energy from a movement of the ERA cover plate without significantly bending the main penetrator rod.

* * * * *